US006323811B1

(12) United States Patent
Tsubaki et al.

(10) Patent No.: US 6,323,811 B1
(45) Date of Patent: Nov. 27, 2001

(54) SURFACE-MOUNT ANTENNA AND COMMUNICATION DEVICE WITH SURFACE-MOUNT ANTENNA

(75) Inventors: Nobuhito Tsubaki, Shiga-ken; Shoji Nagumo, Kawasaki; Kazunari Kawahata, Machida, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/807,636

(22) PCT Filed: Sep. 28, 2000

(86) PCT No.: PCT/JP00/06709

§ 371 Date: Apr. 16, 2001

§ 102(e) Date: Apr. 16, 2001

(87) PCT Pub. No.: WO01/24316

PCT Pub. Date: Apr. 5, 2001

(30) Foreign Application Priority Data

Sep. 30, 1999 (JP) ..... 11-279154

(51) Int. Cl.[7] ..... H01Q 1/24; H01Q 1/38
(52) U.S. Cl. ..... 343/700 MS; 343/702
(58) Field of Search ..... 343/700 MS, 702, 343/860, 846, 848

(56) References Cited

U.S. PATENT DOCUMENTS

| | | | | |
|---|---|---|---|---|
| 5,903,240 | * | 5/1999 | Kawahata et al. | 343/700 MS |
| 6,133,881 | * | 10/2000 | Kushihi et al. | 343/700 MS |
| 6,147,650 | * | 11/2000 | Kawahata et al. | 343/700 MS |
| 6,177,908 | * | 1/2001 | Kawahata et al. | 343/700 MS |

FOREIGN PATENT DOCUMENTS

| | | |
|---|---|---|
| 7-131234 | 5/1995 | (JP) . |
| 9-153734 | 6/1997 | (JP) . |
| 11-127014 | 5/1999 | (JP) . |
| 2000151258 | 5/2000 | (JP) . |

* cited by examiner

*Primary Examiner*—Tan Ho
(74) *Attorney, Agent, or Firm*—Ostrolenk, Faber, Gerb & Soffen, LLP

(57) ABSTRACT

A first radiating electrode 5 and radiating electrode 6 are formed on an upper face 2*c* of a dielectric base 2 of a surface-mounted antenna 1, and a rectifying circuit 7 is formed on a side face 2*b* where radiating electrodes 5 and 6 are not formed. This facilitates configuration of a desired rectifying circuit 7 appropriate for the surface-mounted antenna 1, and rectification of the surface-mounted antenna 1 is facilitated. Also, since the rectifying circuit 7 is formed on the side face 2*b* of the dielectric base 2, effects of the rectifying circuit 7 on the first radiating electrode 5 and second radiating electrode 6 on the upper face 2*c* can be reduced. Accordingly, high gain and increased bandwidth of the surface-mounted antenna can be obtained.

15 Claims, 10 Drawing Sheets

SURFACE-MOUNT ANTENNA AND COMMUNICATION DEVICE WITH SURFACE-MOUNT ANTENNA

TECHNICAL FIELD

The present invention relates to a surface-mounted antenna provided in communication devices such as cellular telephones and the like, and to a communication device comprising the antenna.

BACKGROUND ART

FIG. 13 schematically shows an example of a conventional surface-mounted antenna. The surface-mounted antenna 1 shown in FIG. 13 is an antenna mounted to a circuit board built into a communication device such as a cellular telephone or the like, and comprises an approximately rectangular parallelepiped dielectric base 2 composed, for example, of a ceramic or resin dielectric member.

A ground electrode 3 is formed over almost the entire surface of the base face 2*a* of this dielectric base 2, and also, an electric power supplying electrode 4 is formed on the area on the base face 2*a* where the ground electrode 3 is not formed, with a predetermined spacing between the electric power supplying electrode 4 and the ground electrode 3. This electric power supplying electrode 4 is formed in a manner extended from the base face 2*a* to the side face 2*b* of the dielectric base 2.

Further, a first radiating electrode 5 and a second radiating electrode 6 are formed from the upper face 2*c* to the side face 2*d* of the dielectric base 2, with a slit S introduced therebetween, and the first radiating electrode 5 and second radiating electrode 6 are both connected to the ground electrode 3.

The surface-mounted antenna 1 shown in FIG. 13 is mounted to the circuit board in a communication device with the base face 2*a* of the dielectric base 2 toward the circuit board. A rectifying circuit 7 and an electric power supplying circuit 8 are formed on the circuit board, and mounting the surface-mounted antenna 1 to the circuit board as described above connects the electric power supplying electrode 4 to the electric power supplying circuit 8 via the rectifying circuit 7 by conduction.

In the state of the surface-mounted antenna 1 being thus mounted to the circuit board, once electric power is supplied to the electric power supplying electrode 4 from the electric power supplying circuit 8 via the rectifying circuit 7, the supplied electric power is transferred by capacitive coupling from the electric power supplying electrode 4 to the first radiating electrode 5 and second radiating electrode 6, and the first radiating electrode 5 and second radiating electrode 6 resonate based on the electric power so as to transmit and receive radio waves.

Now, the resonance frequency (center frequency) of the first radiating electrode 5 and the resonance frequency (center frequency) of the second radiating electrode 6 are mutually offset such that the frequency band of the radio waves transmitted and received by the first radiating electrode 5 and the frequency band of the radio waves transmitted and received by the second radiating electrode 6 overlap partially. Setting the resonance frequencies of the first radiating electrode 5 and second radiating electrode 6 thus creates a compounded resonating state between the first radiating electrode 5 and second radiating electrode 6, thereby realizing wider bandwidth for the surface-mounted antenna 1.

However, with the surface-mounted antenna 1 configured as described above, the electric current vector A of the first radiating electrode 5 and the electric current vector B of the second radiating electrode 6 shown in FIG. 13 are parallel. Also, the width g of the slit S between the first radiating electrode 5 and second radiating electrode 6 is narrow, in order to reduce the size of the surface-mounted antenna 1. Accordingly, there has been the possibility that the conduction electric current of the first radiating electrode 5 and the conduction electric current of the second radiating electrode 6 would exhibit mutual interference, this mutual interference resulting in a phenomena wherein either one or the other of the first radiating electrode 5 and second radiating electrode 6 would hardly resonate at all, so a stable compound resonating state has not been able to be obtained.

As means for avoiding this, preventing mutual interference of the electric currents of the first radiating electrode 5 and second radiating electrode 6 by widening the gap g between the first radiating electrode 5 and second radiating electrode 6 could be conceived. However, in order to accomplish this, the gap g between the first radiating electrode 5 and second radiating electrode 6 would have to be widened by a great deal, thereby increasing the size of the surface-mounted antenna 1.

Accordingly, the present inventor has proposed in Japanese Patent Application No. 10-326695 a surface-mounted antenna 1 such as shown in FIG. 12 as a surface-mounted antenna wherein a stable compound resonating state of the surface-mounted antenna 1 can be obtained, with greater bandwidth, and also the size can be reduced. Incidentally, this surface-mounted antenna is not publicly known at the time of making the present application, and thus does not constitute conventional art with regard to the present invention.

As shown in FIG. 12, with the surface-mounted antenna 1 according to this proposal, the slit S between the first radiating electrode 5 and the second radiating electrode 6 on the upper face 2*c* of the dielectric base 2 is formed at an angle to the square sides of the upper face 2*c* (e.g., at approximately a 45° angle). An open end 5*a* of the first radiating electrode 5 is formed so as to wrap around to the side face 2*e* of the dielectric base 2, and an open end 6*a* of the second radiating electrode 6 is formed on the side face 2*d* of the dielectric base 2.

Further, formed on the side face 2*b* of the dielectric base 2 is an electric power supplying electrode 4 serving as a short-circuiting portion linearly extending from the first radiating electrode 5 to the base face 2*a*, and a short-circuiting portion electrode 10 serving as a short-circuiting portion linearly extending from the second radiating electrode 6 to the base face 2*a* in the same manner.

The surface-mounted antenna 1 shown in FIG. 12 is mounted to the circuit board of the communication device such that the base face 2*a* of the dielectric base 2 is toward the circuit board, and the electric power supplying electrode 4 is connected to the electric power supplying circuit 8 via the rectifying circuit 7 on the circuit board.

In such a state of the surface-mounted antenna 1 being mounted to the circuit board, once electric power is supplied to the electric power supplying electrode 4 from the electric power supplying circuit 8 via the rectifying circuit 7, the electric power is directly supplied to the first radiating electrode 5, and is also transferred to the second radiating electrode 6 by electromagnetic field coupling. Thus, the first radiating electrode 5 and the second radiating electrode 6 resonate, and the surface-mounted antenna 1 operates as an antenna.

With the configuration shown in FIG. 12, the first radiating electrode 5 serves as the electric-power-supplying-side radiating electrode to which electric power is directly supplied from the electric power supplying circuit 7, and the second radiating electrode 6 serves as the non-electric-power-supplying-side radiating electrode to which electric power is indirectly supplied from the first radiating electrode 5. Then, with the configuration shown in FIG. 12, as with the surface-mounted antenna 1 shown in FIG. 13, the resonance frequencies of the first radiating electrode 5 and the second radiating electrode 6 are mutually offset such that a compound resonating state can be realized.

With the surface-mounted antenna 1 according to this proposal, in addition to the slit S between the first radiating electrode 5 and the second radiating electrode 6 being formed at an angle to the sides of the upper face 2*c* as described above, the short-circuiting portions of the first radiating electrode 5 and the second radiating electrode 6 (i.e., the electric power supplying electrode 4 and the short-circuiting portion electrode 10) are both formed on the same side face *b*, and also the open ends 5*a* and 6*a* of the first radiating electrode 5 and the second radiating electrode 6 are respectively formed on mutually differing side faces 2*e* and 2*d* so as to avoid the face 2*a* upon which are formed the above short-circuiting portions 4 and 10.

Due to such a configuration, the electric current vector A of the first radiating electrode 5 and the electric current vector B of the second radiating electrode 6 shown in FIG. 12 are approximately orthogonal, and prevention of mutual interference of the currents of the first radiating electrode 5 and second radiating electrode 6 can be realized effectively without widening the gap g of the slit S between the first radiating electrode 5 and second radiating electrode 6. Accordingly, a stable compound resonating state can be obtained.

In this way, with the surface-mounted antenna 1 shown in FIG. 12, a stable compound resonating state can be obtained without drastically widening the gap g of the slit S between the first radiating electrode 5 and second radiating electrode 6, thereby widening the bandwidth, and also reducing the size.

The rectifying circuit 7 is necessary for operating the surface-mounted antenna 1, so there must always be an area for forming the rectifying circuit 7 as well as the area for forming the surface-mounted antenna 1, on the circuit board for mounting the surface-mounted antenna 1. Thus, the rectifying circuit 7 has impeded improvement in the mounting density of parts on the circuit board.

Also, there is a tendency to use small parts for the parts making up the rectifying circuit 7, in order to reduce the size of the communication device. However, generally, such small parts have poor voltage-tolerance properties, and there is a danger that the parts making up the rectifying circuit 7 cannot withstand a large voltage for suitably exhibiting the properties of the surface-mounted antenna 1, so it has been difficult to supply high electric power to the surface-mounted antenna 1 for suitable operation thereof. Further, as described above, at the time of electric power being supplied to the surface-mounted antenna 1 from the electric power supplying circuit 8 via the rectifying circuit 7, a relatively large conductor loss occurs in the rectifying circuit 7. In this way, not only is it difficult to supply high electric power to the surface-mounted antenna 1 necessary for suitable operation thereof, but also conductor loss occurs at the rectifying circuit 7, so there has been a limit in the improvement in properties of the surface-mounted antenna 1.

Furthermore, the rectifying circuit 7 being thus configured on the circuit board means that there have been various restrictions regarding the configuration of the rectifying circuit 7, such as circuit configuration and parts positioning, etc. That is to say, it has been difficult to configure a desired rectifying circuit 7 at an appropriate position for the surface-mounted antenna 1, leading to the problem that rectification for the surface-mounted antenna 1 is not readily achieved. Accordingly, there has been limited improvement of the return-loss properties (gain properties) of the surface-mounted antenna 1.

DISCLOSURE OF THE INVENTION

The present invention has been made to solve the above-described problems, and it is an object thereof to provide a surface-mounted antenna and a communication device comprising the antenna wherein widening of the bandwidth and reduction in size of the surface-mounted antenna can be realized, deterioration of antenna properties are prevented by enabling the supply of high electric power, facilitating ease of rectification and yielding high gain, and further facilitating increased mounting density of the circuit board of the communication device and a reduction in the cost of parts.

In order to achieve the above objects, the present invention comprises the following configuration as means for solving the above problems.

That is, the surface-mounted antenna according to the present invention comprises an approximately rectangular parallelepiped-shaped dielectric base;

wherein a radiating electrode is formed on an upper face of the dielectric base facing a board mounting bottom face:

and wherein the radiating electrode comprises an electric-power-supplying-side radiating electrode and a non-electric-power-supplying-side radiating electrode positioned away from the electric-power-supplying-side radiating electrode with a predetermined spacing therebetween, configured so as to resonate based on electric power supplied via a rectifying circuit from an external electric power supplying circuit and to perform transmission and reception of radio waves;

wherein a short-circuiting portion of the electric-power-supplying-side radiating electrode and a short-circuiting portion of the non-electric-power-supplying-side radiating electrode are positioned on a side face of the dielectric base in close proximity with a predetermined spacing therebetween;

and wherein an open end portion of the electric-power-supplying-side radiating electrode and an open end portion of the non-electric-power-supplying-side radiating electrode are positioned on mutually different sides so as to avoid the face of the dielectric base upon which the short-circuiting portions are formed; and wherein the rectifying circuit is formed on a side face of the dielectric base, this configuration serving as means for solving the above problems.

Also, with the surface-mounted antenna according to the present invention, the electric-power-supplying-side radiating electrode and the non-electric-power-supplying-side radiating electrode may be formed so that the resonating directions thereof are approximately orthogonal. Further, the rectifying circuit may be formed on a side different from the sides on which the open end of the electric-power-supplying-side radiating electrode and the open end portion of the non-electric-power-supplying-side radiating electrode are formed.

Also, the rectifying circuit may contain an inductance component formed to the short-circuiting portion of the electric-power-supplying-side radiating electrode, and further may contain a capacitor formed between the short-circuiting portion of the electric-power-supplying-side radiating electrode and the short-circuiting portion of the non-electric-power-supplying-side radiating electrode.

Finally, the communication device according to the present invention comprises as a characteristic thereof a surface-mounted antenna according to the present invention.

With the invention of the above configuration, forming a rectifying circuit on the dielectric base of the surface-mounted antenna facilitates configuration of a desired rectifying circuit suitable for the surface-mounted antenna, thereby facilitating rectification between the impedance of the electric power supplying circuit and the input impedance of the antenna. In this way, facilitating ease of rectification of the surface-mounted antenna enables further improvement of gain properties of the surface-mounted antenna, with excellent high-gain and wide bandwidth properties.

Also, a rectifying circuit does not have to be formed on the circuit board to which the surface-mounted antenna is mounted, thereby improving mounting density of parts on the circuit board. Further, the rectifying circuit is configured on the dielectric base of the surface-mounted antenna, so separate parts from the surface-mounted antenna for configuring the rectifying circuit become unnecessary, thereby enabling a reduction in the number of parts making up the communication device, and a reduction in the cost of parts for the communication device.

Further yet, configuring the rectifying circuit from a conductor pattern on the dielectric base of the surface-mounted antenna allows suppression of conductor loss in the rectifying circuit, and also facilitates configuration of a rectifying circuit which can withstand high electrical power, so electric power for operating the surface-mounted antenna in a suitable manner can be supplied, and deterioration of antenna properties due to lack of electric power can be avoided.

BEST MODE FOR CARRYING OUT THE INVENTION

Figure 1A:
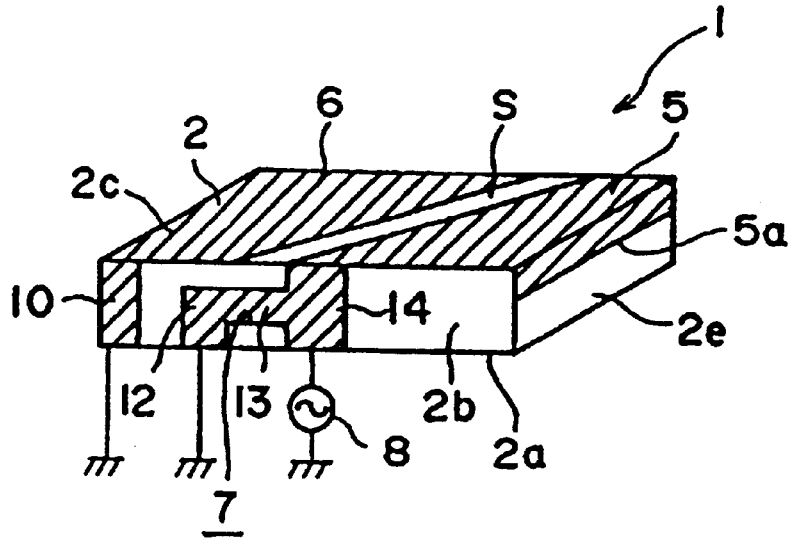
FIG. 1 is an explanatory diagram illustrating an embodiment of the surface-mounted antenna according to the present invention wherein a rectifying circuit has been formed on the dielectric base.

The following is a description of the embodiments according to the present invention, with reference to the drawings. Note that in the description of the embodiments described below, the same components as those of the surface-mounted antenna shown in FIG. 12 above are denoted with the same reference numerals, and redundant description of the common portions will be omitted.

The most characteristic point about the present embodiment is that a rectifying circuit 7 formed of a conductor pattern is formed on a dielectric base 2 of a surface-mounted antenna 1. The present embodiment also has a characteristic configuration in which the rectifying circuit 7 is provided at a position which does not undesirably affect the antenna operations of a first radiating electrode 5 and a second radiating electrode 6, i.e., on a face differing from the face on which the radiating electrodes have been formed on the dielectric base 2 (on a face where the radiating electrodes have not been formed).

Figure 1B:
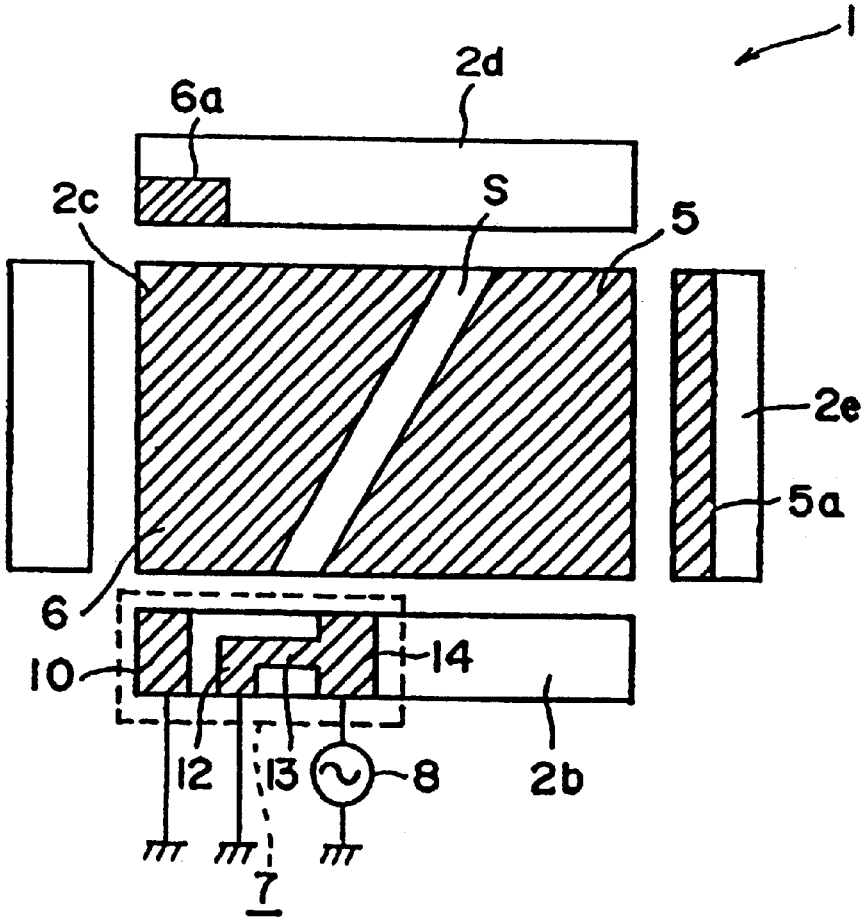

FIG. 1(*a*) is a schematic perspective view illustrating an embodiment of the surface-mounted antenna having the above-described characteristic configuration, and FIG. 1(*b*) shows the surface-mounted antenna shown in FIG. 1(*a*) in the deployed state.

Figure 12:
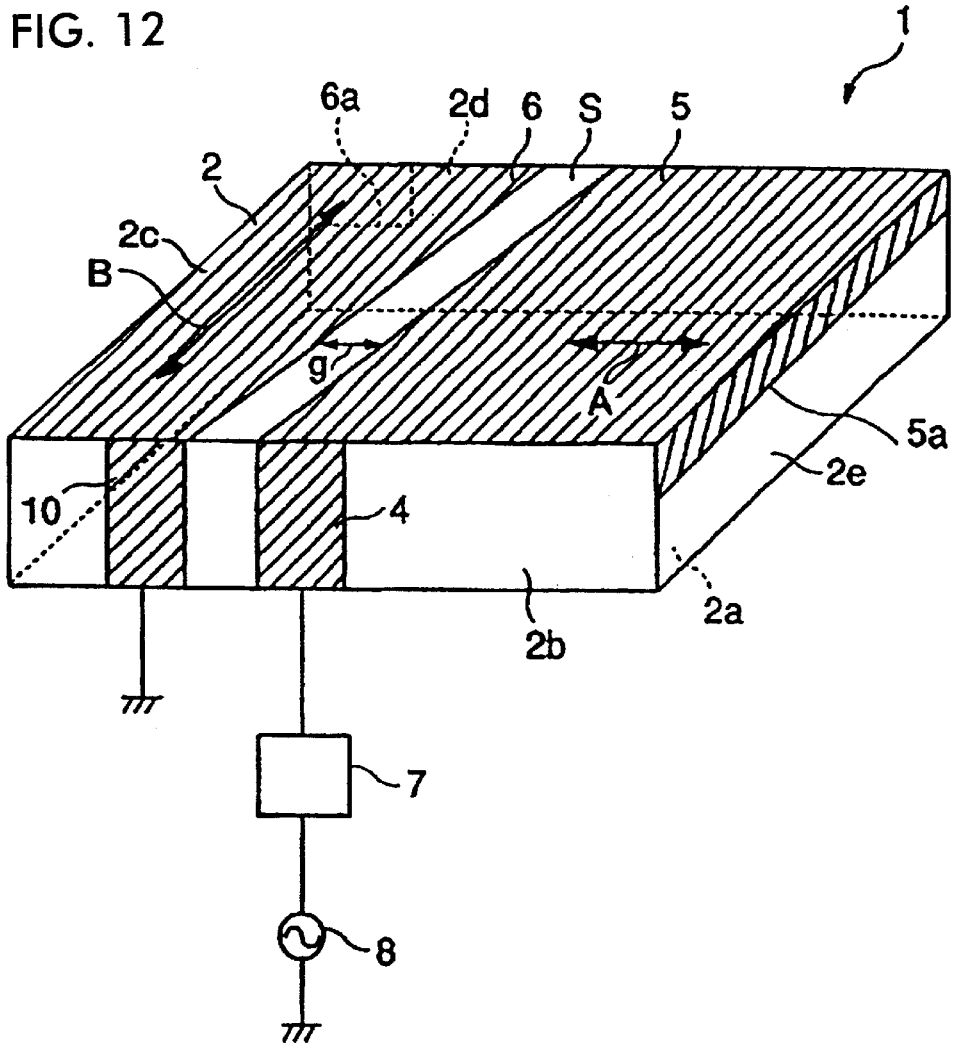
FIG. 12 is an explanatory diagram illustrating an example of a surface-mounted antenna proposed by the present inventor.
Figure 13:
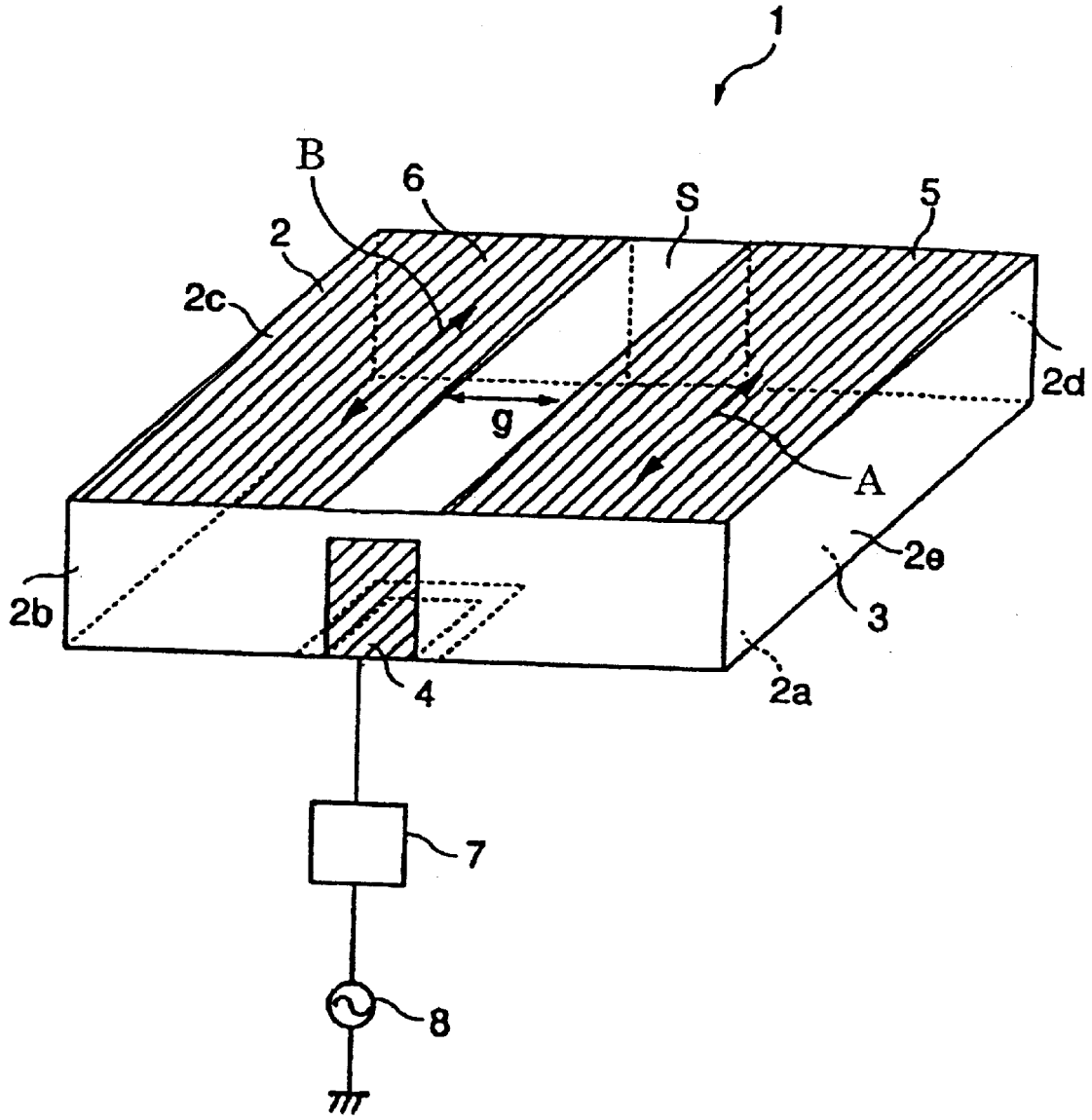
FIG. 13 is an explanatory diagram illustrating an example of a conventional surface-mounted antenna.

A characteristic point in that the surface-mounted antenna 1 shown in FIGS. 1(*a*) and (*b*) differs from the surface-mounted antenna 1 according to the proposed example shown in the above FIG. 12 is that the rectifying circuit 7 is formed on a side face 2*b* of the dielectric base 2. Other configurations thereof are essentially the same as those of the surface-mounted antenna 1 in the above proposed example.

As described above, the rectifying circuit 7 shown in FIGS. 1(*a*) and (*b*) is formed on the side face 2*b* of the dielectric base 2, i.e., a side face different from the upper face on which the first radiating electrode 5 and second radiating electrode 6 are formed, and a side face different from a side face 2*d* on which an open end of the first radiating electrode 5 and an open end of the second radiating electrode 6 are formed. Accordingly, the configuration is such that forming the rectifying circuit 7 on the dielectric base 2 does not undesirably affect the antenna operations of the first radiating electrode 5 and second radiating electrode 6.

Now, as shown in FIGS. 1(*a*) and (*b*), the rectifying circuit 7 comprises a short-circuiting portion electrode 10 which is a short-circuiting portion of the second radiating electrode 6 (non-electric-power-supplying-side radiating electrode), a first rectifying electrode 12 having functions as a short-circuiting portion of the first radiating electrode 5 (electric-power-supplying-side radiating electrode), a second rectifying electrode 13, and a third rectifying electrode 14.

The third rectifying electrode 14 is formed in a linearly extended fashion from the first radiating electrode 5 to the base face 2*a* of the dielectric base 2, and between this third rectifying electrode 14 and the short-circuiting portion electrode 10 is positioned the first rectifying electrode 12 so as to face the short-circuiting portion electrode 10 across a spacing. The upper side of this first rectifying electrode 12 is bent toward the side of the third rectifying electrode 14 and connected to the middle portion of the third rectifying electrode 14, such that this bent portion comprises the second rectifying electrode 13.

The short-circuiting portion electrode 10 and the first rectifying electrode 12 of the rectifying circuit 7 are connected to a ground, and the base face 2*a* side of the third rectifying electrode 14 is connected to the electric power supplying circuit 8 on the circuit board of the communication device.

Figure 2:
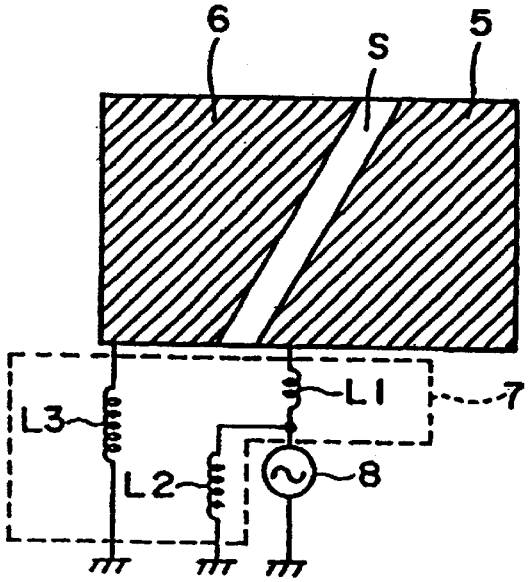
FIG. 2 is an explanatory diagram illustrating an equivalent circuit of the rectifying circuit formed in FIG. 1.

FIG. 2 illustrates an equivalent circuit of the rectifying circuit 7 shown in FIGS. 1(*a*) and (*b*) with the rectifying circuit configured of an electrode pattern (conductor pattern). The third rectifying electrode 14 shown in FIG. 1 corresponds to the inductance L1 shown in FIG. 2, the first rectifying electrode 12 and second rectifying electrode 13 correspond to the inductance L2 shown in FIG. 2, and the short-circuiting portion electrode 10 corresponds to the inductance L3 shown in FIG. 2. That is to say, with the present embodiment, the first rectifying electrode 12, second rectifying electrode 13, third rectifying electrode 14, and short-circuiting portion electrode 10 configure a predetermined inductance, thereby forming the rectifying circuit 7.

With the surface-mounted antenna 1 shown in FIGS. 1(*a*) and (*b*), the electric power supplied from the electric power supplying circuit 8 passes through the first rectifying electrode 12, second rectifying electrode 13, and third rectifying electrode 14 of the rectifying circuit 7, and is transferred to the first radiating electrode 5, and is also transferred from the first rectifying electrode 12 by electromagnetic field coupling to the second radiating electrode 6 via the short-circuiting portion electrode 10, so that the first radiating electrode 5 and the second radiating electrode 6 perform antenna operation. In the example shown in this FIGS. 1(*a*) and (*b*), the first rectifying electrode 12, second rectifying electrode 13, and third rectifying electrode 14 make up the rectifying circuit 7, and also function as a short-circuiting portion to supply electric power to the first radiating electrode 5.

Now, with the present invention, the rectifying circuit 7 formed on the dielectric base 2 can take various circuit configurations, and is not restricted to the circuit configuration shown in FIG. 2. The following illustrates circuit configuration examples of the rectifying circuit 7 other than those described above, and electrode patterns of the rectifying circuit 7.

Figure 3A:
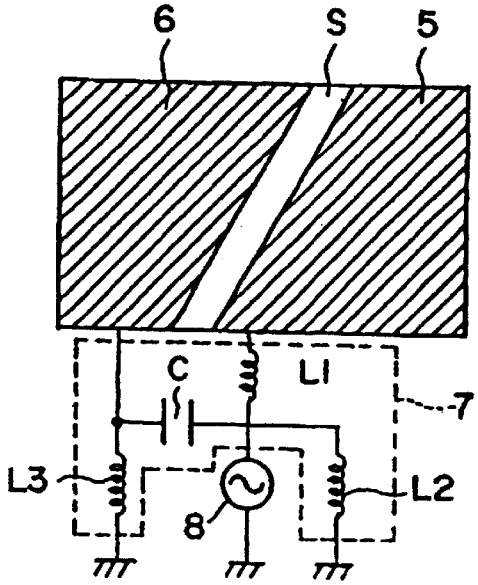
FIG. 3 is an explanatory diagram illustrating another example of the rectifying circuit formed on the dielectric base of the surface-mounted antenna according to the present invention.
Figure 3B:
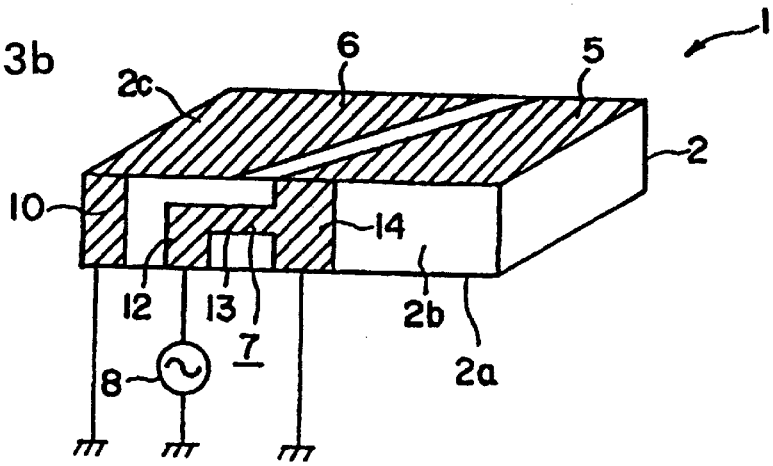

FIG. 3(*a*) shows another circuit configuration example of the rectifying circuit 7, and FIG. 3(*b*) shows an example of an electrode pattern for configuring the rectifying circuit 7 shown in FIG. 3(*a*). This electrode pattern of the rectifying circuit 7 shown in FIG. 3(*b*) is the same electrode pattern as the rectifying circuit 7 shown in FIG. 1, but the electric power supplying circuit 8 is connected to the base face 2*a* at the first rectifying electrode 12 instead of the third rectifying electrode 14, and the base face 2*a* sides of the short-circuiting portion electrode 10 and third rectifying electrode 14 are connected to a ground.

The first rectifying electrode 12, second rectifying electrode 13, and third rectifying electrode 14 of the rectifying circuit 7 shown in FIG. 3(*b*) correspond to the inductance L1 and L2 shown in FIG. 3(*a*), the short-circuiting portion electrode 10 and first rectifying electrode 12 facing each other corresponding to the capacitor C shown in FIG. 3(*a*), and the short-circuiting portion electrode 10 corresponds to the inductance L3 shown in FIG. 3(*a*). That is to say, with the rectifying circuit configuration example shown in FIG. 3, the predetermined inductance and capacitance are configured with the first rectifying electrode 12, second rectifying electrode 13, third rectifying electrode 14, and short-circuiting portion 10, thus making up the rectifying circuit 7.

Figure 4A:
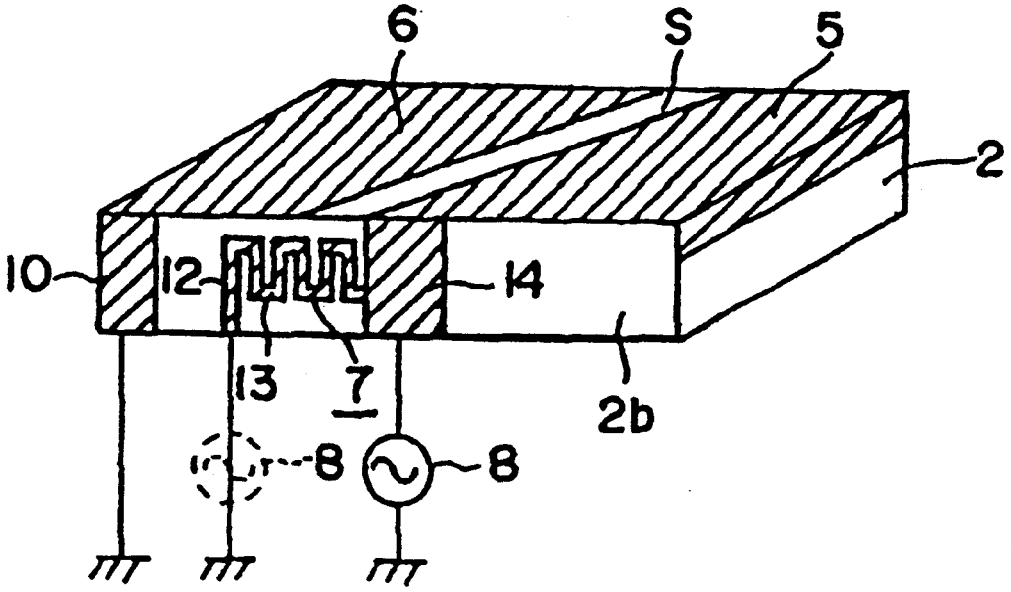
FIG. 4 is an explanatory diagram illustrating another example of the rectifying circuit formed on the dielectric base of the surface-mounted antenna according to the present invention.
Figure 4B:
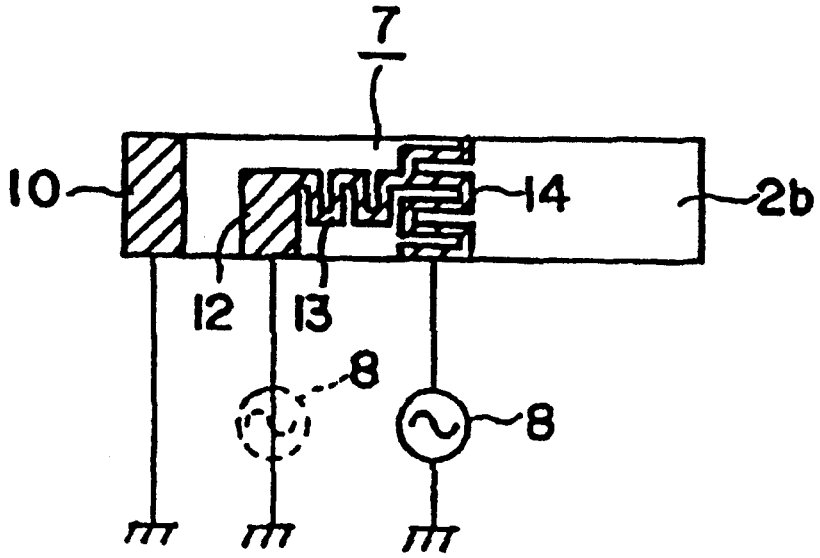
Figure 5A:
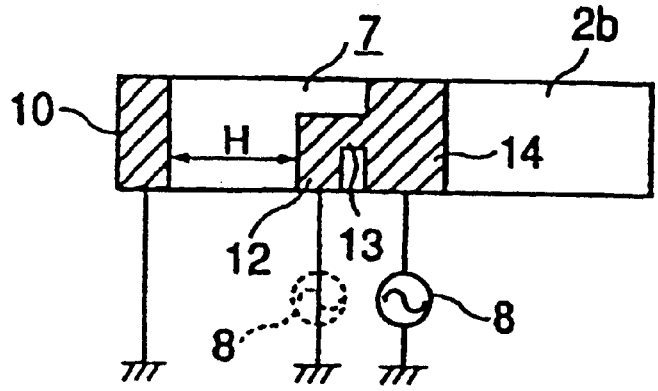
FIG. 5 is an explanatory diagram illustrating another example of the rectifying circuit formed on the dielectric base of the surface-mounted antenna according to the present invention.
Figure 5B:
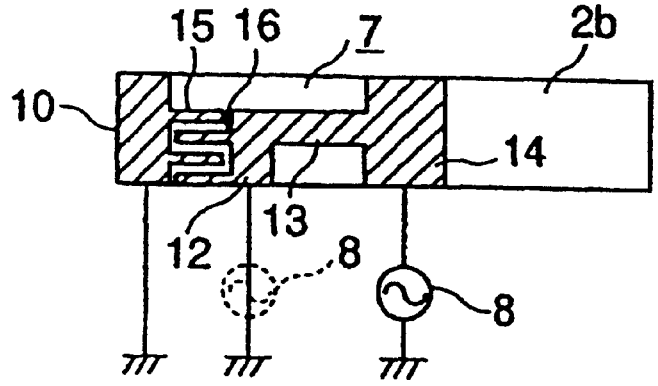
Figure 5C:
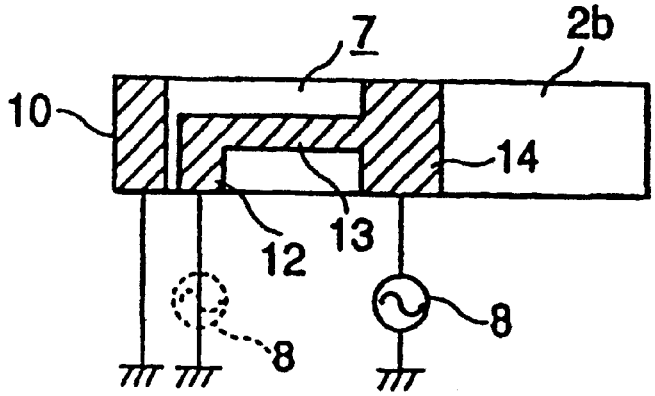

FIGS. 4(*a*) and (*b*) and FIGS. 5(*a*), (*b*), and (*c*) respectively illustrate variations of the electrode patterns of the rectifying circuits 7 shown in FIG. 1 and FIG. 3. As shown by the solid lines in FIGS. 4(*a*) and (*b*) and FIGS. 5(*a*), (*b*), and (*c*), connecting the third rectifying electrode 14 to the electric power supplying circuit 8 configures the rectifying circuit 7 shown in FIG. 2, and as shown by the dotted lines, connecting the first rectifying electrode 12 to the electric power supplying circuit 8 configures the rectifying circuit 7 shown in FIG. 3(*a*).

In the example shown in FIG. 4(*a*), the second rectifying electrode 13 is formed in a meandering shape. Thus, the inductance component of the second rectifying electrode 13 is raised as compared to the rectifying circuits 7 shown in FIG. 1 and FIG. 3.

In the example shown in FIG. 4(*b*), the third rectifying electrode 14 is formed in a meandering shape as well as the second rectifying electrode 13, so the inductance component of the second rectifying electrode 13 and third rectifying electrode 14 is raised as compared to the rectifying circuits 7 shown in FIG. 1 and FIG. 3.

In the example shown in FIG. 5(*a*), the spacing H between the short-circuiting portion electrode 10 and the first rectifying electrode 12 is formed wider than the examples shown in FIG. 1 and FIG. 3, so coupling between the short-circuiting portion electrode 10 and the first rectifying electrode 12 is weakened as compared to the examples shown in FIG. 1 and FIG. 3.

In the example shown in FIG. 5(*b*), a comb-shaped electrode 15 is formed extending from the short-circuiting portion electrode 10 towards the first rectifying electrode 12 side, and a comb-shaped electrode 16 is formed extending from the first rectifying electrode 12 so as to mesh with the comb-shaped electrode 15 with a predetermined spacing therebetween. Thus, forming comb-shaped electrodes 15 and 16, which respectively connect to the short-circuiting portion electrode 10 and the first rectifying electrode 12 and mesh with a predetermined spacing therebetween, strengthens the coupling between the short-circuiting portion electrode 10 and the first rectifying electrode 12 as compared to the examples shown in FIG. 1 and FIG. 3.

The example shown in FIG. 5(*c*) is, like the example shown in FIG. 5(*b*), an arrangement wherein the coupling between the short-circuiting portion electrode 10 and the first rectifying electrode 12 has been strengthened as compared to the examples shown in FIG. 1 and FIG. 3. Specifically, the spacing between the short-circuiting portion electrode 10 and the first rectifying electrode 12 has been narrowed, thereby strengthening the coupling between the short-circuiting portion electrode 10 and the first rectifying electrode 12.

Figure 6A:
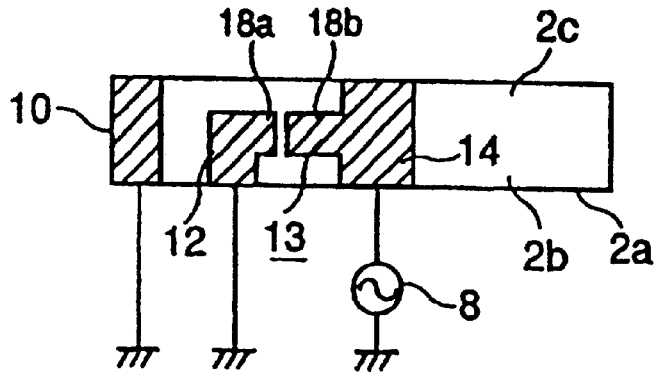
FIG. 6 is an explanatory diagram illustrating another example of the rectifying circuit formed on the dielectric base of the surface-mounted antenna according to the present invention.
Figure 6B:
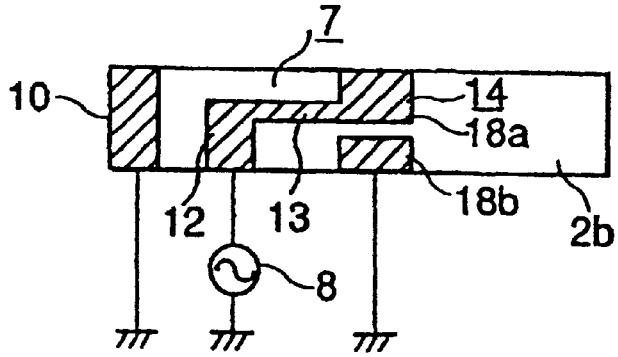
Figure 6C:
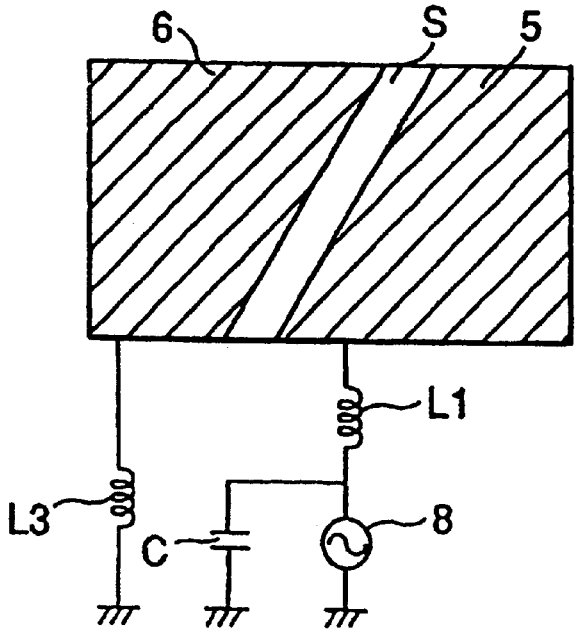

FIGS. 6(*a*) and (*b*) each illustrate electrode pattern examples making up the rectifying circuit 7 shown in FIG. 6(*c*).

The electrode pattern example of the rectifying circuit 7 shown in FIG. 6(*a*) is almost the same as the electrode pattern of the rectifying circuit 7 shown in FIG. 1, but a differing feature is that the second rectifying electrode 13 is separated, and capacitor-forming electrodes 18*a* and 18*b* facing one another across a predetermined gap have been formed. In the example shown in this FIG. 6(*a*), the electric power supplying circuit 8 is connected to the third rectifying electrode 14.

The third rectifying electrode 14 shown in this FIG. 6(*a*) corresponds to the inductance L1 shown in FIG. 6(*c*), the short-circuiting portion electrode 10 corresponds to the inductance L3 shown in FIG. 6(*c*), and the capacitor-forming electrodes 18*a* and 18*b* correspond to the capacitor C shown in FIG. 6(*c*).

With the example shown in FIG. 6(*b*), as with the example shown in FIG. 6(*a*), the second rectifying electrode 13 is not separated, rather the third rectifying electrode 14 is separated, and capacitor-forming electrodes 18*a* and 18*b* facing one another across a gap are formed, and the second rectifying electrode 13 is connected to the capacitor-forming electrode 18*a* which is connected to the first radiating electrode 5.

With the example shown in FIG. 6(*b*), the electric power supplying circuit 8 is connected to the first rectifying electrode 12. The first rectifying electrode 12, the second rectifying electrode 13, and the capacitor-forming electrodes 18*a* shown in FIG. 6(*b*) correspond to the inductance L1 shown in FIG. 6(*c*), the short-circuiting portion electrode 10 corresponds to the inductance L3 shown in FIG. 6(*c*), and the capacitor-forming electrodes 18*a* and 18*b* correspond to the capacitor C shown in FIG. 6(*c*).

Figure 7A:
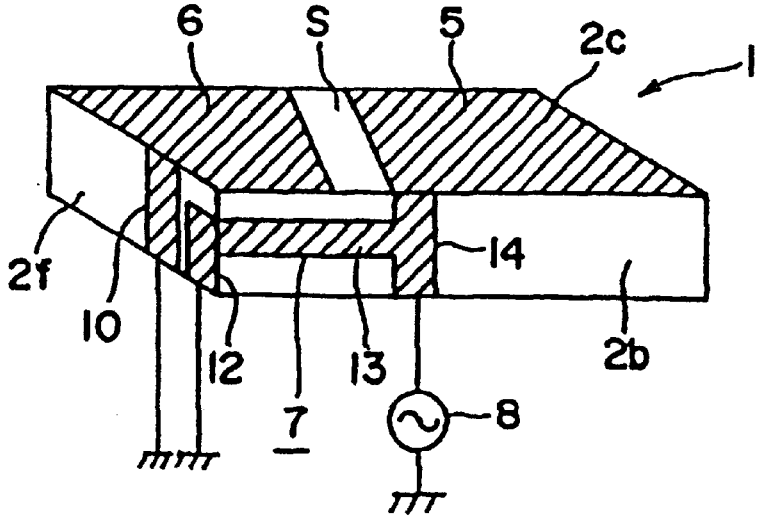
FIG. 7 is an explanatory diagram illustrating another example of the rectifying circuit formed on the dielectric base of the surface-mounted antenna according to the present invention.
Figure 7B:
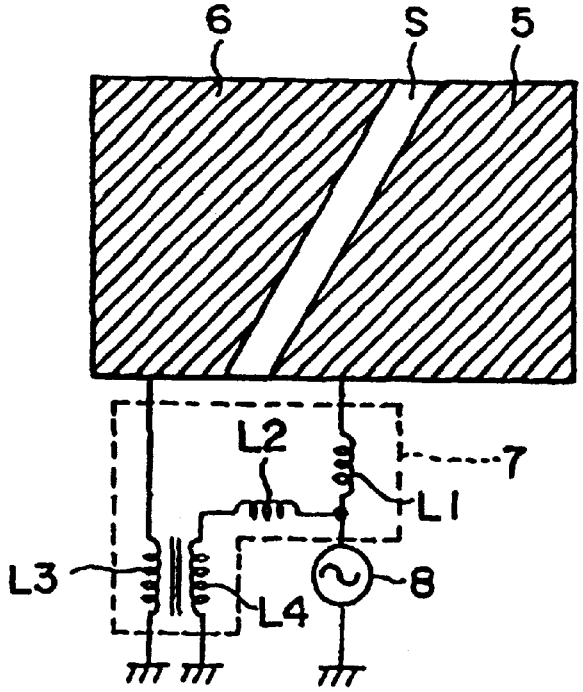

Now, with the electrode pattern examples of the rectifying circuit 7 described above, the electrode pattern of the rectifying circuit 7 has been formed only on the side face 2*b* of the dielectric base 2, but as shown in FIG. 7(*a*), the electrode pattern of the rectifying circuit 7 may be formed over multiple faces of the dielectric base 2. In the example shown in FIG. 7(*a*), the short-circuiting portion electrode 10 and first rectifying electrode 12 making up the rectifying circuit 7 are formed on the side face 2*f* of the dielectric base 2, and the second rectifying electrode 13 and third rectifying electrode 14 are formed on the side face 2*b*. The electrode pattern of the rectifying circuit 7 shown in FIG. 7(*a*) configures a circuit shown in FIG. 7(*b*).

As described above, the present embodiment is characterized in that the rectifying circuit 7 is formed on the dielectric base 2 of the surface-mounted antenna 1, and the electrode pattern of the rectifying circuit 7 formed on the dielectric base 2 is configured so as to obtain good rectification.

Figure 8:
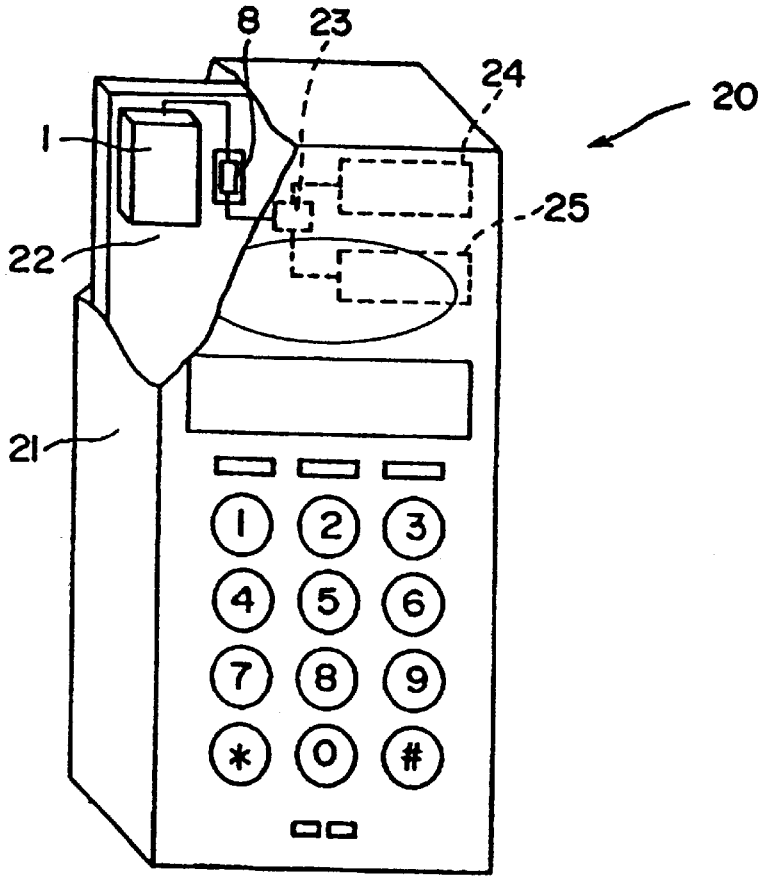
FIG. 8 is an explanatory diagram illustrating an example of a communication device comprising the surface-mounted antenna according to the present invention illustrated in the above embodiments.

FIG. 8 illustrates an example of a cellular telephone device which is a communication device comprising a surface-mounted antenna 1 which has the rectifying circuit 7. The cellular telephone device 20 shown in FIG. 8 has a circuit board 22 provided within a case 21. An electric power supplying circuit 8, a switching circuit 23, a transmission circuit 24, and a reception circuit 25 are provided on the circuit board 22. Also mounted to the circuit board 22 is a surface-mounted antenna 1 such as described above, with the surface-mounted antenna 1 being connected to the transmission circuit 24 and reception circuit 25 via the electric power supplying circuit 8 and switching circuit 23.

With the cellular telephone device 20 shown in FIG. 8, the surface-mounted antenna 1 performs antenna operations as described above by predetermined electric power (signals) being provided to the surface-mounted antenna 1 from the electric power supplying circuit 8, and transmission and reception of radio waves is smoothly carried out by the switching operation of the switching circuit 23.

Figure 9:
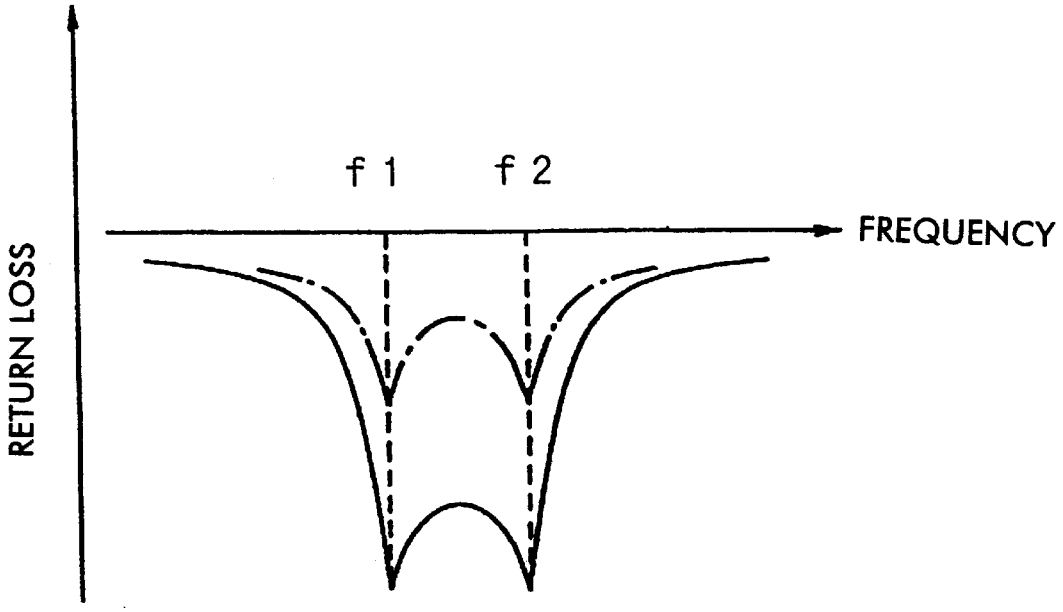
FIG. 9 is a graph illustrating return-loss properties for indicating return-loss improvement effects obtained by a characteristic configuration of the present invention.
Figure 10A:
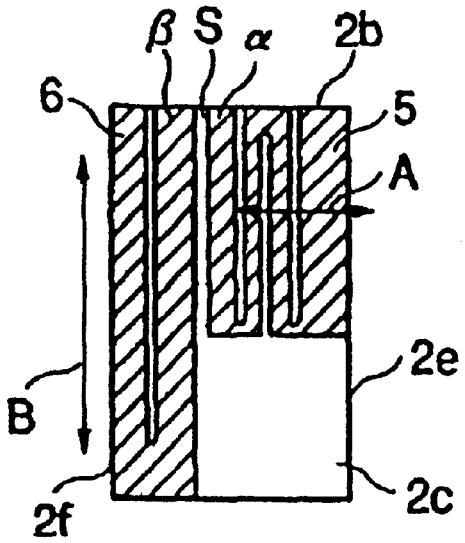
FIG. 10 is an explanatory diagram illustrating another example of the form of the radiating electrodes of the present invention.
Figure 10B:
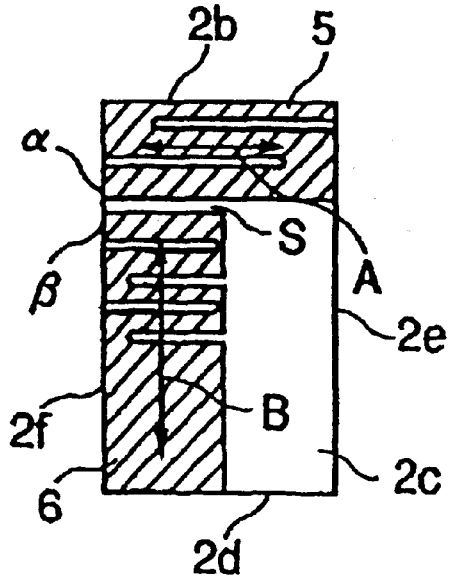
Figure 10C:
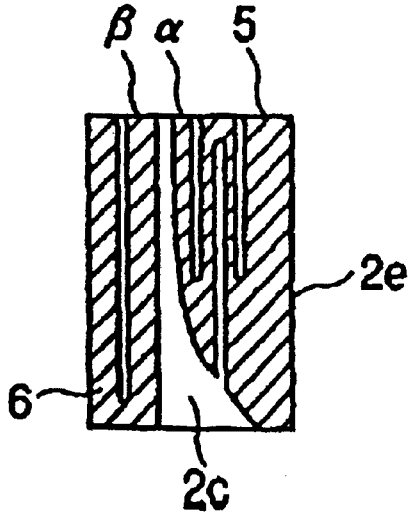
Figure 10D:
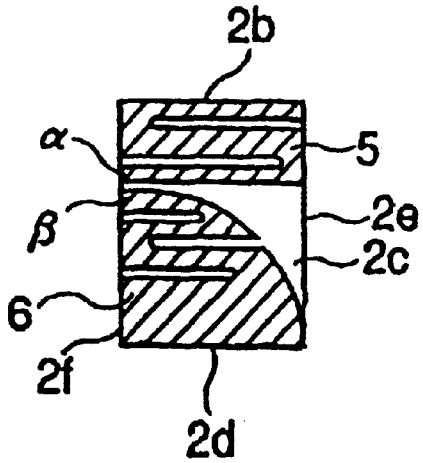

According to the present embodiment, the rectifying circuit 7 has been formed on the dielectric base 2 of the surface-mounted antenna 1, thereby facilitating ease of configuring a desired rectifying circuit 7 appropriate for the surface-mounted antenna 1, so as to perform rectification for the surface-mounted antenna 1. Thus, the return-loss properties of the surface-mounted antenna shown by the solid line in FIG. 9 can be markedly improved over the return-loss properties of the conventional surface-mounted antenna shown by the broken line in FIG. 9. Thus, the return-loss properties can be improved, so high gain and larger bandwidth can be achieved for the surface-mounted antenna 1. Note that the frequency f1 shown in FIG. 9 is one or the other of the resonance frequencies of the first radiating electrode 5 and second radiating electrode 6, and the frequency f2 is the resonance frequency of the other radiating electrode.

Also, with the present embodiment, the rectifying circuit 7 has been formed on the side face 2*b* of the dielectric base 2 which is a different face from the face on which the radiating electrodes have been formed, so the rectifying circuit 7 does not have adverse effects on the antenna operations of the first radiating electrode 5 and second radiating electrode 6, and thus deterioration of antenna properties due to the rectifying circuit 7 can be prevented.

Further, with the present embodiment, the electric current vectors of the first radiating electrode 5 and second radiating electrode 6 are approximately orthogonal, as with the surface-mounted antenna 1 in the above proposed example. Accordingly, mutual interference of electric current of the first radiating electrode 5 and second radiating electrode 6 can be effectively prevented without increasing the width of the slot S between the first radiating electrode 5 and second radiating electrode 6. Thus, a stable compound resonating state can be obtained, and the transmission/reception bandwidth can be increased, while also reducing the size.

Further, with the present embodiment, as described above, the rectifying circuit 7 is formed on the surface-mounted antenna 1, so a rectifying circuit 7 does not have to be formed on the circuit board upon which the surface-mounted antenna 1 is mounted. The area of the circuit board available for mounting parts is enlarged by the area where the rectifying circuit 7 does not have to be formed on the circuit board, thus facilitating ease of improving mounting density of the circuit board.

Further, as described above, with the present embodiment the rectifying circuit 7 is formed on the surface-mounted antenna 1, so the rectifying circuit 7 can be mounted to the circuit board in the single step of mounting the surface-mounted antenna 1 to the circuit board, doing away with the need for the task of mounting the parts forming the rectifying circuit 7 in addition to the task of mounting the surface-mounted antenna 1. This allows manufacturing costs of the communication device to be lowered. Also, the number of parts for the communication device can be reduced, thereby reducing the cost of parts for the communication device.

Further, with the present embodiment, the rectifying circuit 7 formed from an electrode pattern is formed on the surface-mounted antenna 1, so a rectifying circuit 7 capable of tolerating a large electric power can be easily formed without the worry of increased size of the communication device, and also conduction loss at the rectifying circuit 7 can be suppressed to an extremely low level. Hence, a high electric power for suitably exhibiting antenna properties can be supplied to the surface-mounted antenna 1, and deterioration of properties of the surface-mounted antenna 1 due to lack of electric power can be avoided.

Figure 11:
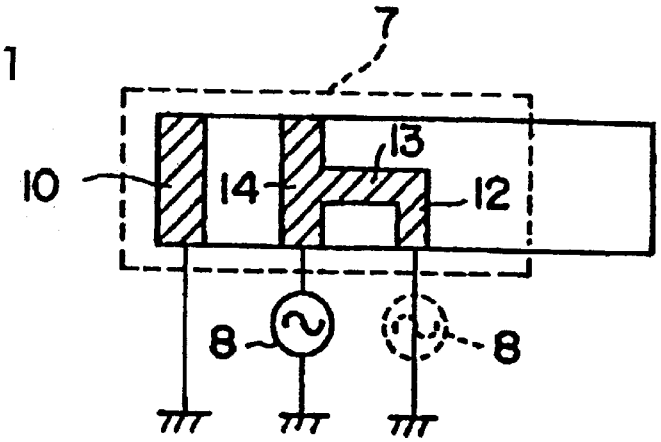
FIG. 11 is an explanatory diagram illustrating another example of the form of the rectifying circuit of the present invention.

Note that the present invention is not restricted to the above-described embodiments, but rather may take on various forms. For example, multiple examples of electrode patterns for the rectifying circuit 7 were shown with the above embodiments, but the electrode patterns for the rectifying circuit 7 are not restricted to the above examples. For example, with the examples of the electrode patterns for the rectifying circuit 7, the first rectifying electrode 12 and second rectifying electrode 13 were formed between the short-circuiting portion electrode 10 and the third rectifying electrode 14, but an arrangement may be made such as that shown in FIG. 11 wherein the third rectifying electrode 14 is positioned adjacent to the short-circuiting portion electrode 10 with a gap introduced therebetween, the second rectifying electrode 13 is formed in a manner extended from the middle portion of the third rectifying electrode 14 towards the side opposite to the short-circuiting portion electrode 10, and the first rectifying electrode 12 is connected to the tip of this second rectifying electrode 13.

Also, the first radiating electrode 5 and second radiating electrode 6 are not restricted to the forms described in the above embodiments, but rather may take on forms such as those shown in FIGS. 10(*a*) through (*d*), for example.

With the examples shown in FIGS. 10(*a*) through (*d*), the first radiating electrode 5 and second radiating electrode 6 are formed having meandering shapes. With the example shown in FIG. 10(*a*), electric power is supplied to the second radiating electrode 6 from a meandering end portion α, and also power is supplied to the first radiating electrode 5 from a meandering end portion β, and the short-circuit portions of the first radiating electrode 5 and second radiating electrode 6 are formed on the side face 2*b* of the dielectric base 2. Also, the open end of the first radiating electrode 5 is formed on the side face 2*e*, and the open end of the second radiating electrode 6 is formed on the side face 2*f*. Forming the first radiating electrode 5 and second radiating electrode 6 thus generates the electric current vector A shown in FIG. 10(*a*) at the first radiating electrode 5 and the electric current vector B at the second radiating electrode 6 approximately orthogonal to the electric current vector A at the first radiating electrode 5.

The electric current vectors of the first radiating electrode 5 and second radiating electrode 6 are approximately orthogonal in the example shown in FIG. 10(*a*) as well, as with the above-described embodiment, and accordingly, mutual interference of electric current of the first radiating electrode 5 and second radiating electrode 6 can be prevented, and a stable compound resonating state can w be obtained.

In the example shown in FIG. 10(*b*), the short-circuiting portions connecting to the electric power supplying end portions α and β of the first radiating electrode 5 and second radiating electrode 6 are formed on the side face 2*f* of the dielectric base 2, with the open end of the first radiating electrode 5 being formed on the side face 2*b* and the open end of the second radiating electrode 6 being formed on the side face 2*d*. The electric current vector A of the first radiating electrode 5 and electric current vector B of the second radiating electrode 6 are approximately orthogonal in the example shown in FIG. 10(*b*) as well, and accordingly, as described above, mutual interference of electric currents of the first radiating electrode 5 and second radiating electrode 6 can be prevented, and a stable compound resonating state can be obtained.

Also, the examples shown in FIGS. 10(*c*) and (*d*) are arrangements wherein the electrode area of the open end side of one radiating electrode of the first radiating electrode 5 and second radiating electrode 6 shown in 10(*a*) and (*b*) has been enlarged to improve antenna properties.

Note that though the examples shown in FIGS. 10(*a*) through (*d*) involve both the first radiating electrode 5 and second radiating electrode 6 being formed in a meandering shape, an arrangement may be made wherein only one of the first radiating electrode 5 and second radiating electrode 6 have a meandering shape. Of course, the first radiating electrode 5 and second radiating electrode 6 may also take on forms other than the forms shown in FIG. 1 according to the above-described embodiment or the forms shown in FIGS. 10(*a*) through (*d*).

Further, a cellular telephone device has been given as an example of a communication device with the present embodiment, but the communication device according to the present invention is not restricted to cellular telephone devices, and application can also be made to communication devices other than cellular telephone devices.

Thus, according to the present invention, a rectifying circuit has been provided upon the dielectric base of the surface-mounted antenna, thereby facilitating ease of configuring a desired rectifying circuit appropriate for the surface-mounted antenna, and ease of rectification of between the electric power supplying circuit and the antenna is facilitated. Thus, good rectification of the surface-mounted antenna can be obtained, facilitating improvement of the gain of the surface-mounted antenna. Also, this provides a wider bandwidth of the surface-mounted antenna.

Further, the rectifying circuit has been formed on the upper face of the dielectric base, i.e., a different face from the face on which the radiating electrodes have been formed, so adverse effects of the rectifying circuit on the antenna operations of the radiating electrodes can be prevented, and thus problems of deterioration of antenna properties due to providing the rectifying circuit on the dielectric base can be prevented.

Further, the radiating electrodes comprise an electric-power-supplying-side radiating electrode and a non-electric-power-supplying-side radiating electrode, and particularly arranging the configuration such that the resonating direction of the electric-power-supplying-side radiating electrode and the resonating direction of the non-electric-power-supplying-side radiating electrode are approximately orthogonal can prevent mutual interference of electric currents of the electric-power-supplying-side radiating electrode and non-electric-power-supplying-side radiating electrode without widening the spacing between the electric-power-supplying-side radiating electrode and non-electric-power-supplying-side radiating electrode. Obtaining such a stable compound resonating state allows the transmission/reception bandwidth of the surface-mounted antenna to be widened even further.

Also, as described above, the transmission/reception bandwidth of the surface-mounted antenna can be widened without widening the spacing between the electric-power-supplying-side radiating electrode and non-electric-power-supplying-side radiating electrode, so the size of the surface-mounted antenna can be reduced, thereby providing a surface-mounted antenna which readily encourages reduction in size, high gain, and more bandwidth, all in a well-balanced manner.

Further, forming the rectifying circuit of a conductor pattern on the surface-mounted antenna enables the configuration of a rectifying circuit capable of withstanding high voltages, and also suppressing conduction loss at the rectifying circuit to an extremely low level. Hence, a high electric power for suitably exhibiting properties can be supplied to the surface-mounted antenna, and properties deterioration of the surface-mounted antenna due to lack of electric power can be prevented.

A communication device provided with the surface-mounted antenna having this characteristic configuration according to the present invention comprises a high-gain surface-mounted antenna as described above, so extremely good communication can be performed in a stable manner. Also, a rectifying circuit does not have to be formed on the circuit board upon which the surface-mounted antenna is mounted, so the area of the circuit board available for mounting parts is enlarged by the area where the rectifying circuit is not formed. Also, the number of parts can be reduced, thereby reducing the cost of parts for the communication device. Further, the rectifying circuit can be mounted to the circuit board in the single step of mounting the surface-mounted antenna to the circuit board, thus doing away with the need for the task of mounting the parts forming the rectifying circuit to the circuit board in addition to the task of mounting the surface-mounted antenna, which allows manufacturing costs of the communication device to be lowered. Moreover, as described above, the rectifying circuit does not need to be formed on the circuit board, so the circuit board can be designed without being restricted with regards to a predetermined positioning area of the rectifying circuit, thereby enabling improved freedom in design.

INDUSTRIAL APPLICABILITY

As can be clearly understood from the above description, the surface-mounted antenna according to the present invention is applied to a surface-mounted antenna provided in a communication device such as, for example, a cellular telephone device or the like. Also, the communication device comprising the antenna according to the present invention is applied to a communication device such as, for example, a cellular telephone device or the like.

What is claimed is:

1. A surface-mounted antenna comprising an approximately rectangular parallelepiped-shaped dielectric base;

wherein a radiating electrode is formed on an upper face of said dielectric base facing a board mounting bottom face, and wherein said radiating electrode comprises an electric-power-supplying-side radiating electrode and a non-electric-power-supplying-side radiating electrode positioned away from said electric-power-supplying-side radiating electrode with a predetermined spacing therebetween, configured so as to resonate based on electric power supplied via a rectifying circuit from an external electric power supplying circuit and to perform transmission and reception of radio waves;

wherein a shorting portion of said electric-power-supplying-side radiating electrode and a shorting portion of said non-electric-power-supplying-side radiating electrode are positioned on a side face of said dielectric base in close proximity with a predetermined spacing therebetween;

wherein an open end portion of said electric-power-supplying-side radiating electrode and an open end portion of said non-electric-power-supplying-side radiating electrode are positioned on mutually different sides so as to avoid the face of said dielectric base upon which said shorting portions are formed; and wherein said rectifying circuit is formed on a side face of said dielectric base.

2. A surface-mounted antenna according to claim 1, wherein said electric-power-supplying-side radiating electrode and said non-electric-power-supplying-side radiating electrode are formed so that the resonating directions thereof are approximately orthogonal.

3. A surface-mounted antenna according to claim 2, wherein said rectifying circuit is formed on a side different from the sides on which the open end of said electric-power-supplying-side radiating electrode and the open end portion of said non-electric-power-supplying-side radiating electrode are formed.

4. A surface-mounted antenna according to claim 2, wherein said rectifying circuit contains an inductance component formed at the shorting portion of said electric-power-supplying-side radiating electrode.

5. A surface-mounted antenna according to claim 2, wherein said rectifying circuit contains a capacitor formed between the shorting portion of said electric-power-supplying-side radiating electrode and the shorting portion of said non-electric-power-supplying-side radiating electrode.

6. A communication device, comprising a surface-mounted antenna according to claim 2.

7. A surface-mounted antenna according to claim 1, wherein said rectifying circuit is formed on a side different from the sides on which the open end of said electric-power-supplying-side radiating electrode and the open end portion of said non-electric-power-supplying-side radiating electrode are formed.

8. A surface-mounted antenna according to claim 3, wherein said rectifying circuit contains an inductance component formed at the shorting portion of said electric-power-supplying-side radiating electrode.

9. A surface-mounted antenna according to claim 7, wherein said rectifying circuit contains a capacitor formed between the shorting portion of said electric-power-supplying-side radiating electrode and the shorting portion of said non-electric-power-supplying-side radiating electrode.

10. A communication device, comprising a surface-mounted antenna according to claim 7.

11. A surface-mounted antenna according to claim 1, wherein said rectifying circuit contains an inductance component formed at the shorting portion of said electric-power-supplying-side radiating electrode.

12. A communication device, comprising a surface-mounted antenna according to claim 11.

13. A surface-mounted antenna according to claim 1, wherein said rectifying circuit contains a capacitor formed between the shorting portion of said electric-power-supplying-side radiating electrode and the shorting portion of said non-electric-power-supplying-side radiating electrode.

14. A communication device, comprising a surface-mounted antenna according to claim 13.

15. A communication device, comprising a surface-mounted antenna according to claim 1.

* * * * *